US008409060B2

(12) United States Patent
Hsu

(10) Patent No.: US 8,409,060 B2
(45) Date of Patent: Apr. 2, 2013

(54) EXERCISE BIKE FOR REHABILITATION

(75) Inventor: Ching-Lu Hsu, Taipei County (TW)

(73) Assignee: Gee Hoo Fitec Corp., Taipei County (TW)

( * ) Notice: Subject to any disclaimer, the term of this patent is extended or adjusted under 35 U.S.C. 154(b) by 420 days.

(21) Appl. No.: 12/774,477

(22) Filed: May 5, 2010

(65) Prior Publication Data

US 2011/0275486 A1 Nov. 10, 2011

(51) Int. Cl.
*A63B 22/06* (2006.01)

(52) U.S. Cl. ..... 482/57; 482/62; 601/23

(58) Field of Classification Search ..... 482/57–65
See application file for complete search history.

(56) References Cited

U.S. PATENT DOCUMENTS 4,586,706 A * 5/1986 Chen ..... 482/62
4,618,141 A * 10/1986 Ashworth, Jr. ..... 482/62
4,705,269 A * 11/1987 DeBoer et al. ..... 482/62
4,712,789 A * 12/1987 Brilando ..... 482/62
4,712,790 A * 12/1987 Szymski ..... 482/62
4,824,102 A * 4/1989 Lo ..... 482/59
4,842,268 A * 6/1989 Jenkins ..... 482/53
4,885,939 A * 12/1989 Martin ..... 73/379.01
4,902,001 A * 2/1990 Balbo ..... 482/62
5,114,391 A * 5/1992 Pitzen et al. ..... 482/62
5,156,412 A * 10/1992 Meguerditchian ..... 280/241
5,795,270 A * 8/1998 Woods et al. ..... 482/72
5,836,856 A * 11/1998 Mattoo et al. ..... 482/62
5,906,563 A * 5/1999 Pittari ..... 482/62
5,961,423 A * 10/1999 Sellers ..... 482/57
5,992,253 A * 11/1999 Petersen ..... 74/132
6,042,518 A * 3/2000 Hildebrandt et al. ..... 482/57
6,557,678 B1 * 5/2003 Simonds ..... 192/12 B
6,557,679 B1 * 5/2003 Warner et al. ..... 192/17 D
7,160,230 B2 * 1/2007 Tremblay ..... 482/52
7,510,512 B1 * 3/2009 Taggett ..... 482/62
7,530,932 B2 * 5/2009 Lofgren et al. ..... 482/62
7,789,808 B2 * 9/2010 Lee ..... 482/62
7,922,627 B2 * 4/2011 Clark et al. ..... 482/57
8,007,412 B2 * 8/2011 Lofgren et al. ..... 482/62
2002/0025888 A1 * 2/2002 Germanton et al. ..... 482/1
2011/0275484 A1 * 11/2011 Beard ..... 482/51
2011/0275486 A1 * 11/2011 Hsu ..... 482/57
2012/0289380 A1 * 11/2012 Chen ..... 482/52

* cited by examiner

*Primary Examiner* — Stephen Crow
(74) *Attorney, Agent, or Firm* — Tracy M. Heims; Apex Juris, PLLC

(57) ABSTRACT

An exercise bike for rehabilitation includes a frame, on which a first exercise module designed for training hands, a second exercise module designed for training feet, and a damping device to provide the first and second exercise modules loadings are provided. The first and second exercise modules each has two opposite one-way clutches that user may use to independently train his/her hand or feet without interference.

10 Claims, 8 Drawing Sheets

EXERCISE BIKE FOR REHABILITATION

BACKGROUND OF THE INVENTION

1. Field of the Invention

The present invention relates generally to a training machine, and more particularly to an exercise bike for rehabilitation.

2. Description of the Related Art

Exercise bike is an indoor training machine with a structure similar to a bicycle. Typically, a conventional exercise bike includes a frame, a seat, a handle, two pedals, and a damping device. A user may sit on the seat and step on the pedals to exercise. The damping device provides a loading when the user steps on the pedals to train muscles. The user holds the handle to keep balanced when he/she steps on the pedals.

The conventional exercise bike only trains muscles on the user's feet. An improved exercise bike is equipped with two swinging handle bars that a user may move his/her hands with the handle bars when he/she steps on the pedals. However, the handle bars only swing freely that it is less effective in training hands' muscles. One may provide a damping device on the handle bars to increase loading for training muscles. It will raise the cost and enlarge the size. One may connect the damping device of the pedals to the handle bars through a belt. However, the handle bars will be restricted in moving synchronously with the pedals. That is, the handle bars will move whenever user steps on the pedals, or the pedals will turn whenever user swings the handle bars. It affects the exercise when user only wants to train his/her hands or feet.

Besides, the conventional bike only works when the user steps on the pedals or swings the handle bars in a predetermined direction. The damping device will not work in a reverse direction. Sometime, user may have to turn the pedals or swing the handle bars in the reverse direction for a specific purpose, and the conventional bike can't provide such function.

For a bike with handle bars, the bars are pivoted on a crank directly that the angle of swing of the handle bars is too big for a normal user. The user has to over-flex his/her elbows and wrists when he/he holds the handle bars and moves with them. It may cause musculoskeletal injury when a user takes exercise with the handle bars for a long time.

SUMMARY OF THE INVENTION

The primary objective of the present invention is to provide an exercise bike that can train hands' and feet's muscles individually.

The secondary objective of the present invention is to provide an exercise bike with a design that conforms to ergonomics to provide a comfortable exercise condition.

According to the objectives of the present invention, an exercise bike includes a frame, on which a first exercise module, a second exercise module, and a damping device are provided. The first exercise module includes a main axle, a driving wheel mounted on the main wheel, and a forward one-way clutch between the main axle and the driving wheel. The main axle is driven to rotate in a forward direction and a backward direction that the driving wheel is driven to rotate in the forward direction through the forward one-way clutch when the main axle rotates in the forward direction. The second exercise module includes a main axle, a driving wheel mounted on the main wheel, and a forward one-way clutch between the main axle and the driving wheel. The main axle is driven to rotate in a forward direction and a backward direction that the driving wheel is driven to rotate in the forward direction through the forward one-way clutch when the main axle rotates in the forward direction. The damping device has a driven wheel connected to the frame. The driving wheel of the first exercise module and the driving wheel of the second exercise module are connected to the driven wheel respectively for driving the driven wheel to rotate.

In an embodiment, the first exercise module further includes an operation set, which includes a linkage with an end connected to the main axle, a connector pivoted on an opposite end of the linkage, and a crank pivoted on the connector to provide user a comfortable holding posture.

DETAILED DESCRIPTION OF THE INVENTION

Figure 1:
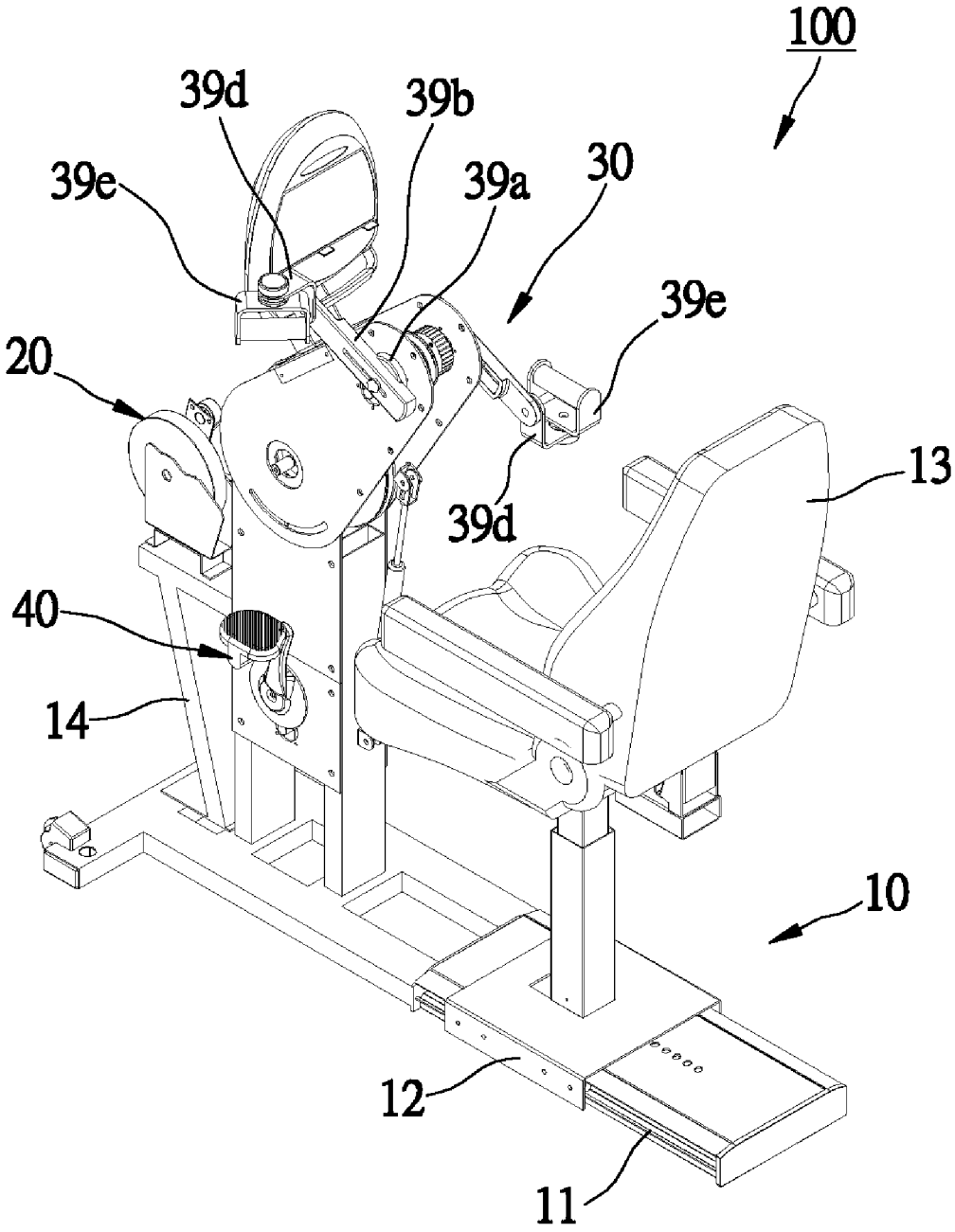
FIG. 1 is a perspective view of a preferred embodiment of the present invention.

As shown in FIG. 1 to FIG. 4, an exercise bike 100 of the preferred embodiment of the present invention includes a frame 10, a damping module 20, a first exercise module 30, and a second exercise module 40.

The frame 10 includes a base 11, a movable base 12 connected to the base 11 for free movement, a seat 13 fixed to a top of the movable base 12, and a support frame 14 with a plurality of bars fixed to the base 11. The frame 10 further has an axle 15, a wheel 16, a first case 17, a second case 18, and an orienting device 19. The axle 15 passes through the conjunction of the first case 17 and the second case 18. The wheel 16, which is mounted on the axle 15, has an outer wheel **16*a* and an inner wheel 16*b* of concentricity. The orienting device 19 is a cylinder including a cylinder member 19*a* and a shaft 19*b*. The cylinder member 19*a* is pivoted on the support frame 14, and the shaft 19*b* is pivoted on the first case 17 that it may adjust an angle between the first case 17 and the second case 18 by activating the cylinder 19 to locate the first case 17** at a desired position.

The damping device 20, which is connected to the support frame 14 of the frame 10, includes a driven wheel 21 and a belt 22. The belt 22 is wound around the driven wheel 21 and the inner wheel **16*b* of the wheel 16. The damping device 20** is a conventional device with which user may adjust the loading value.

The first exercise module 30 is designed for manual operation. The first exercise module 30 is provided on the first case 17 distal to the axle 15 including a main axle 31, a driving wheel 32, a forward one-way clutch 33, a transmission gear 34, a backward one-way clutch 35, a positioning axle 36, a turning gear 37, a belt 38, and two operation sets 39.

Figure 5:
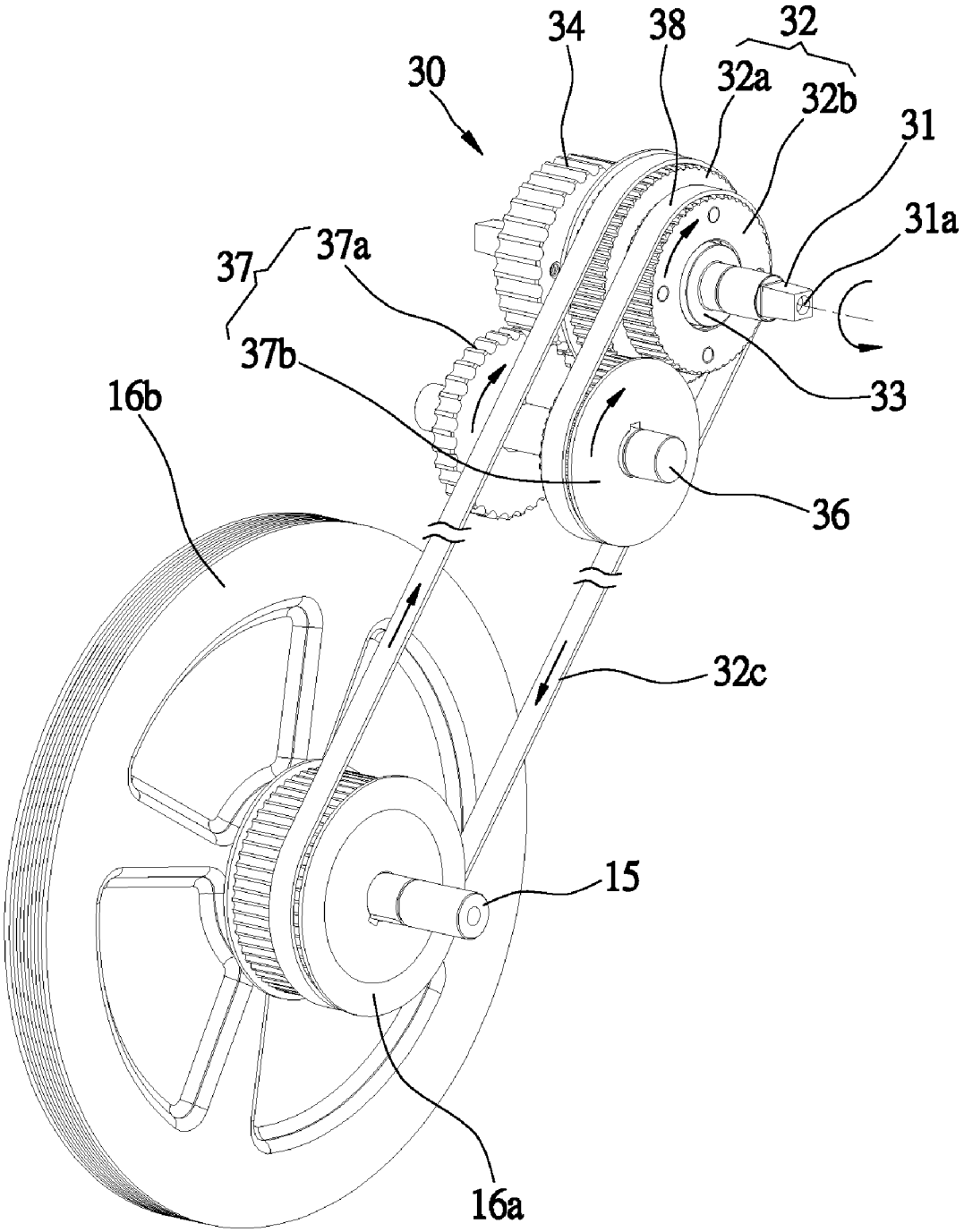
FIG. 5 and FIG. 6 are sketch diagrams of the relationship of the switching wheel of the bike and the first exercise module.
Figure 6:
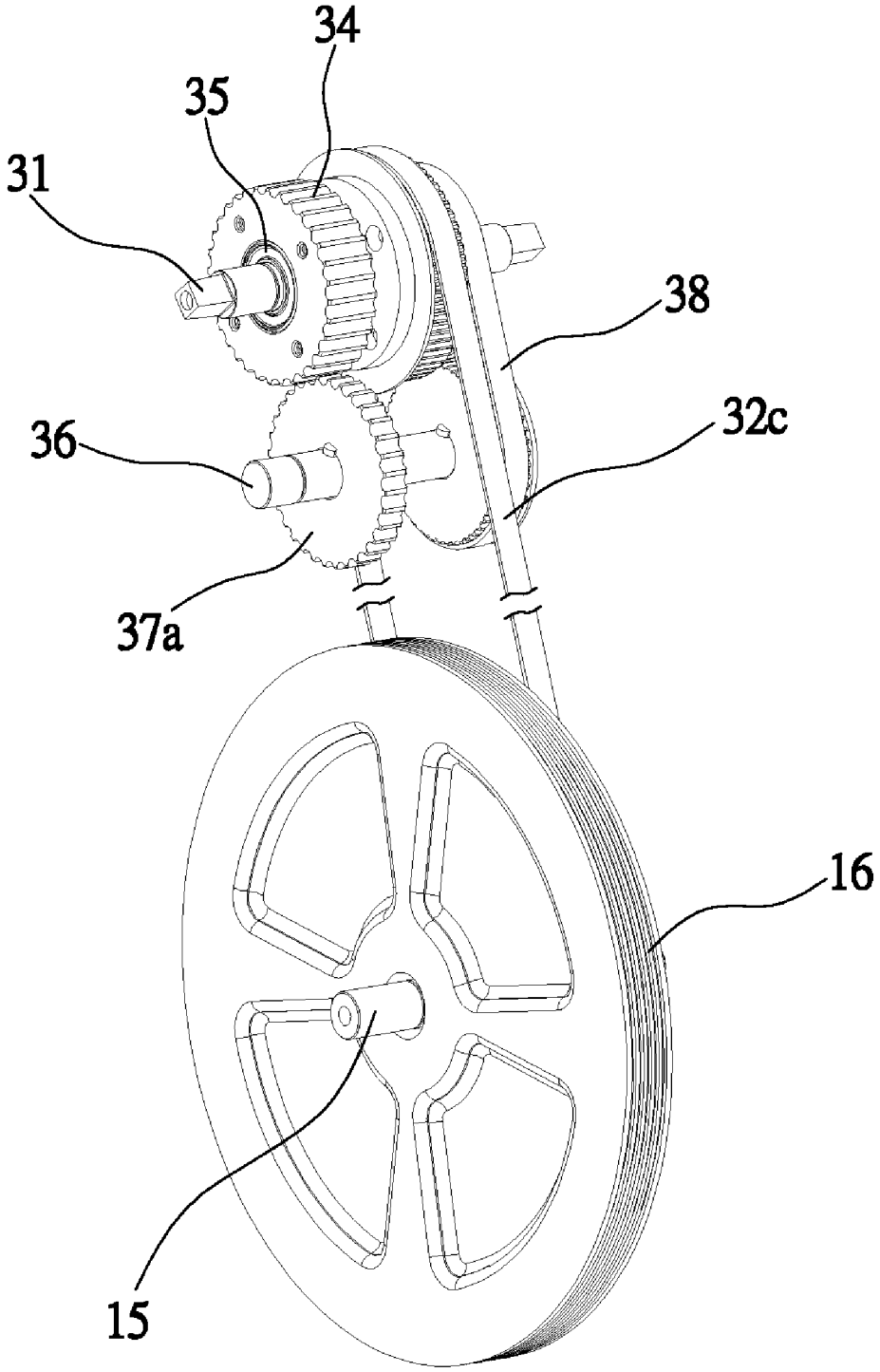

As shown in FIG. 5 and FIG. 6, the main axle 31 passes through the first case 17 with a threaded hole **31*a*** at opposite ends.

The driving wheel 32 is mounted on the main axle 31 including a first gear 32*a* and a second gear 32*b*. The first gear 32*a* is connected to the outer wheel 16*a* of the wheel 16 through a belt 32*c*.

The forward one-way clutch 33 is mounted on the main axle 31 between the main axle 31 and the driving wheel 32. In the present invention, the forward one-way clutch 33 is a one-way bearing that the driving wheel 32 will be turned in a forward direction, i.e., clockwise, through the forward one-way clutch 33 when the main axle 31 is turned in the forward direction, and the driving wheel 32 will not be driven to rotate when the main axle 31 is turned in a backward direction, i.e., counterclockwise.

The transmission gear 34 is mounted on the main axle 31, and the backward one-way clutch 35 is between the main axle 31 and the transmission gear 34. The transmission gear 34 will be turned in a backward direction through the backward one-way clutch 35 when the main axle 31 is turned in the backward direction, and the transmission gear 34 will not be driven to rotate when the main axle 31 is turned in a forward direction. In the present invention, backward one-way clutch 35 is a one-way bearing.

The first positioning axle 36 passes through the first case 17 while being parallel to the main axle 31.

Figure 7:
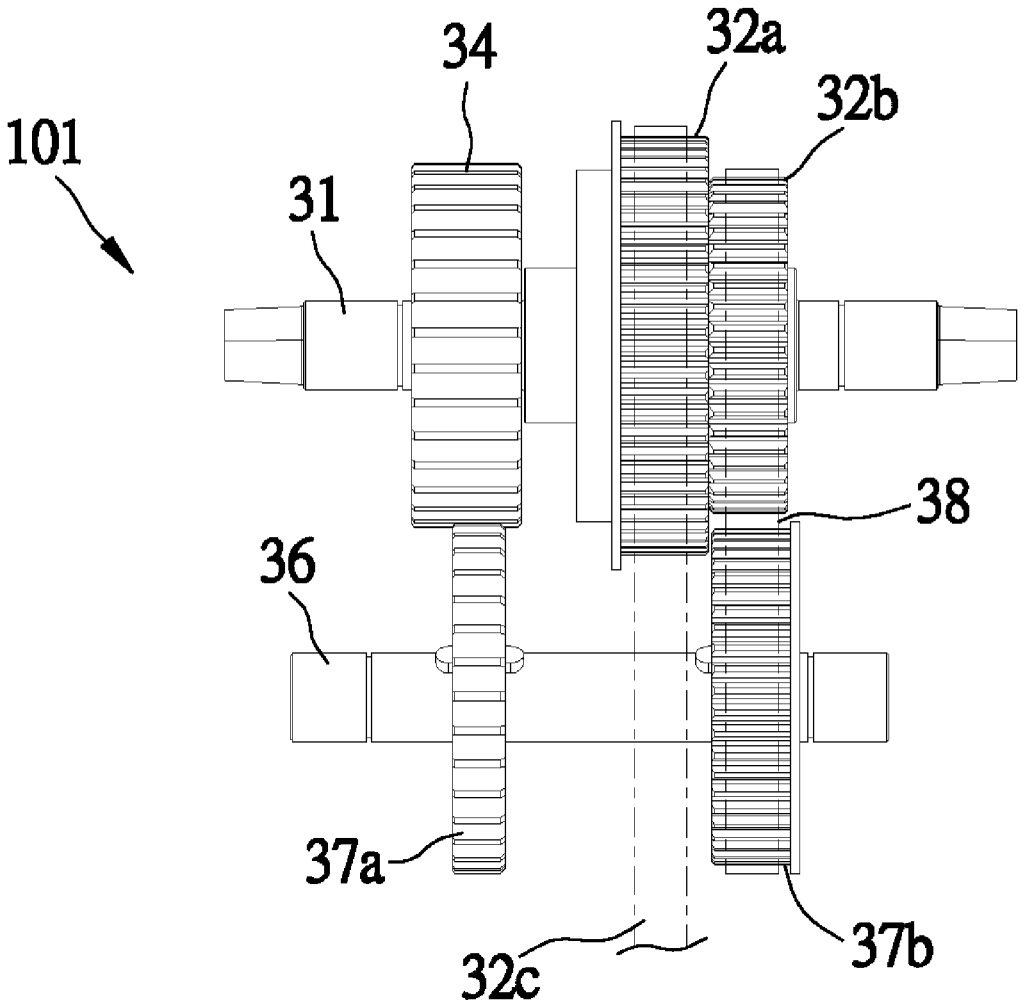
FIG. 7 is a side view of the first exercise module of the preferred embodiment of the present invention.

The turning gear 37 is mounted on the first positioning axle 36 including a first gear 37*a* and a second gear 37*b*. As shown in FIG. 7, the first gear 37*a* is meshed with the transmission gear 34, and the second gear 37*b* is connected to the second gear 32*b* of the driving wheel 32 through the belt 38.

Figure 4:
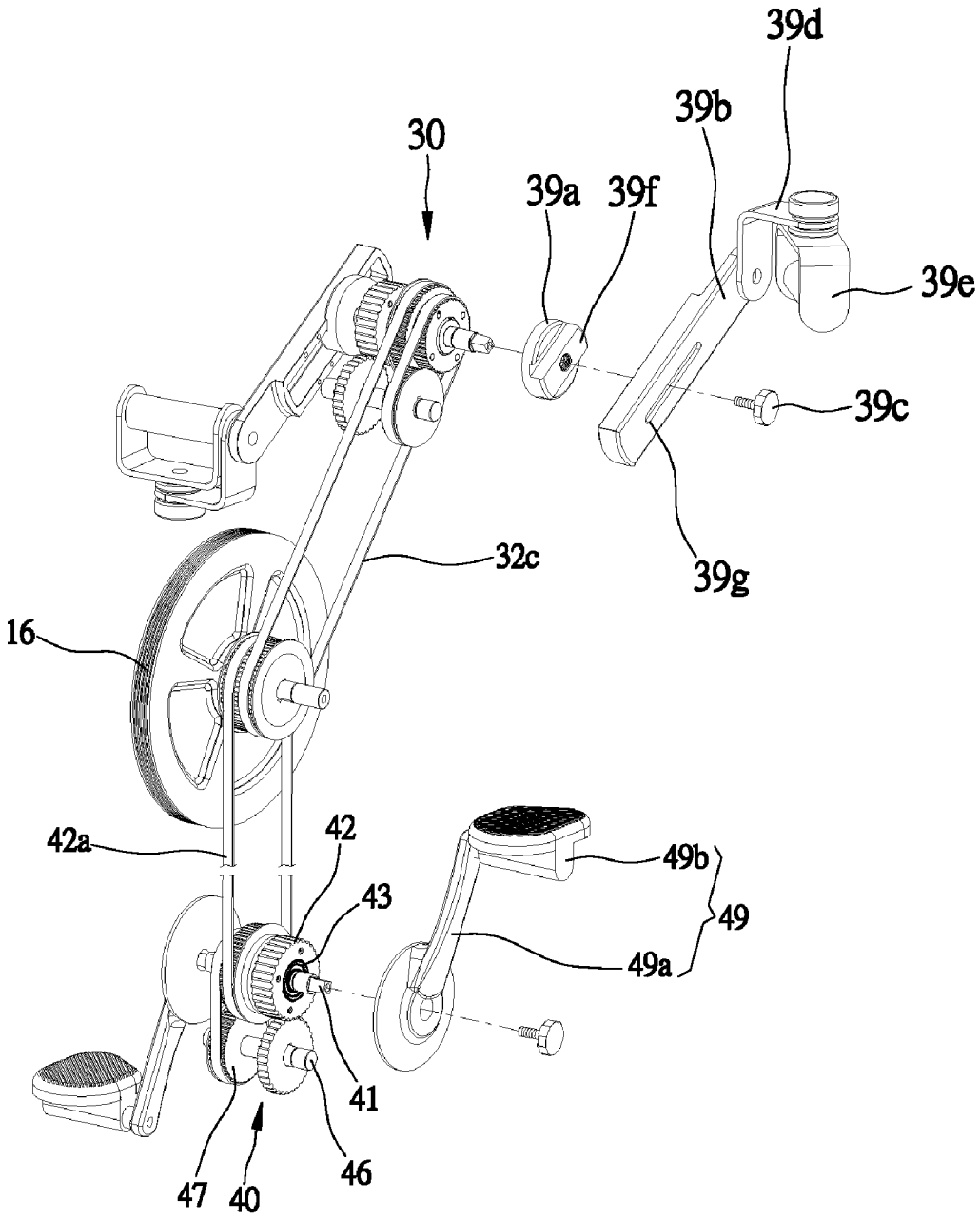
FIG. 4 is a perspective view of the switching wheel of the bike and the first and second exercise modules of the preferred embodiment of the present invention.

The operation sets 39 are mounted at the opposite ends of the main axle 31. As shown in FIG. 4, each of the operation sets 39 include a sheath 39*a*, a linkage 39*b*, a fastener 39*c*, a connector 39*d*, and a crank 39*e*.

The sheath 39*a* is fitted to the end of the main axle 31. The sheath 39*a* has a guiding protrusion 39*f*. The linkage 39*b* has a slot 39*g* to receive the fastener 39*c*. The fastener 39*c* is screwed into the threaded hole 31*a* of the main axle 31 to fix the linkage 39*b* to the main axle 31. The linkage 39 is adjustable along the slot 39*g* when the fastener 39*c* is turned loose. The connector 39*d* is an L-shaped plate with an end pivoted on the linkage 39*c* and an opposite end pivoted on the crank 39*e*. The linkage 39*b* is adjusted to a desired position, with which adjustment the position of the crank 39*e* will be changed, too. When a user holds the cranks 39*e*, the user may apply a comfortable posture to operate the first exercise module 30 through the pivotal connection between the connector 39*d* and the linkage 39*b* and between the crank 39*e* and the connector 39*d* that the user's wrists and elbows will not overly flex.

Figure 2:
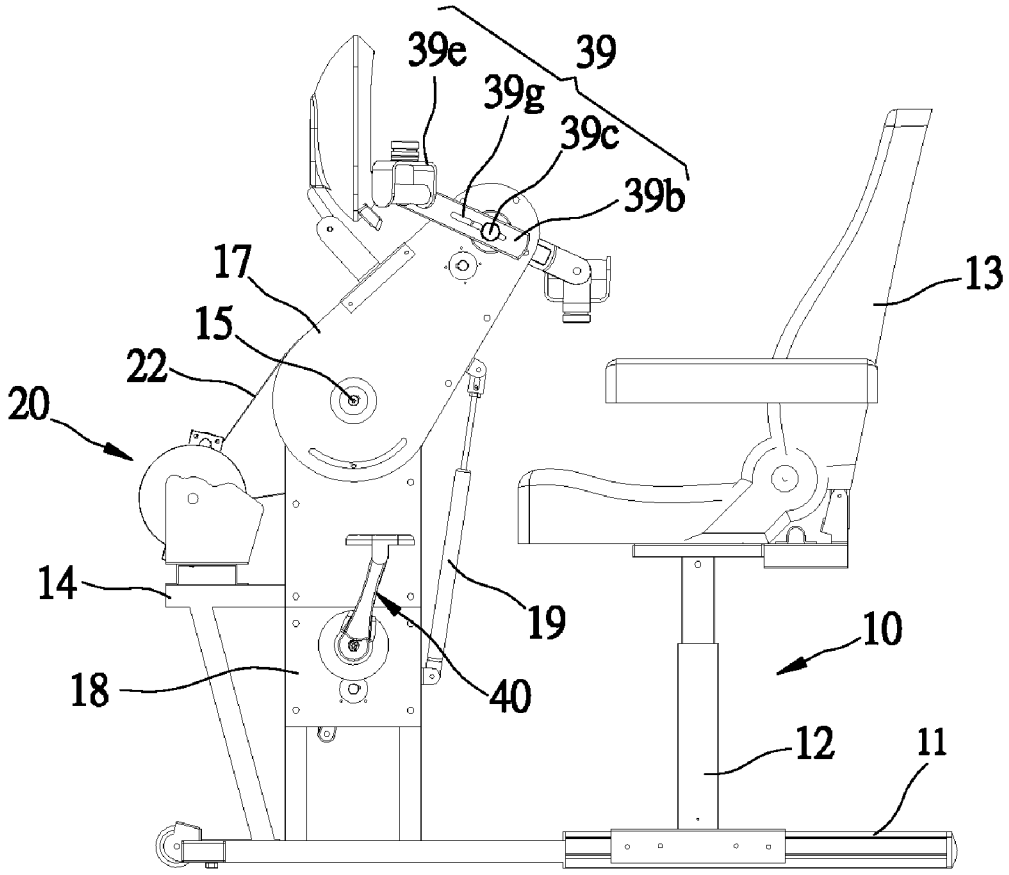
FIG. 2 is a side view of the preferred embodiment of the present invention.
Figure 3:
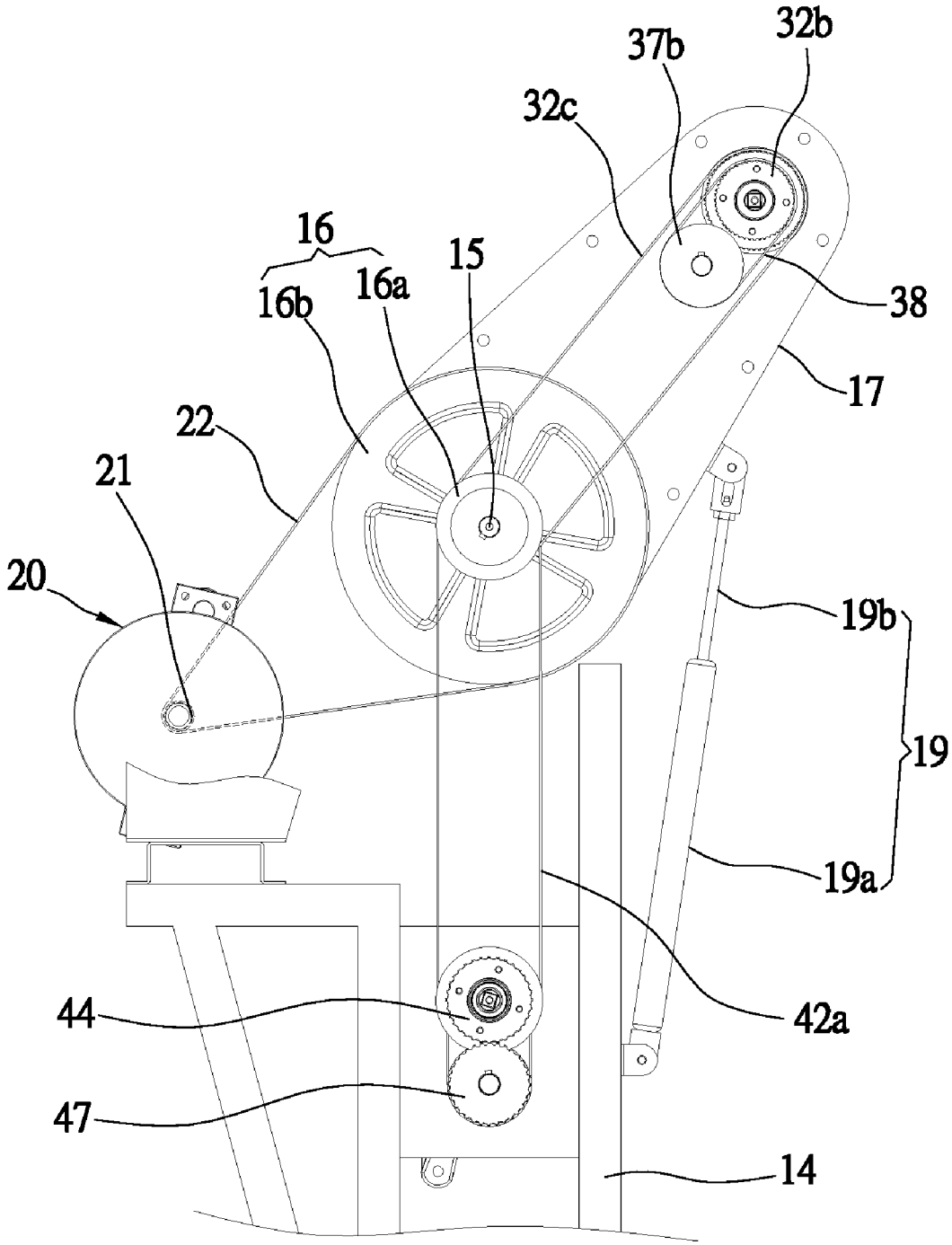
FIG. 3 is a sectional view in parts of the preferred embodiment of the present invention.

As shown in FIG. 1, when a user holds the cranks 39*e* of the operation sets 39 and turns them in a backward direction i.e., counterclockwise, as shown in FIG., the main axle 31 will also be rotated in the backward direction to turn the transmission gear 34 in the same direction through the backward one-way clutch 35. At the same time, the driving wheel 32 is not driven because of the forward one-way clutch 33. The first gear 37*a* of the turning gear 37, which is meshed with the transmission gear 34, is turned in a forward direction, i.e., clockwise, as shown in FIG. 2, and the second gear 37*b* of the turning gear 37 will turn in the forward direction as well to drive the first gear 32*a* of the driving wheel 32 rotating in the forward direction through the belt 38 and the second gear 32*b* of the driving wheel 32. The first gear 32*a* of the driving wheel 32 drives the outer wheel 16*a* of the wheel 16 rotating in the forward direction through the belt 32*c*, and the damping device 20 will provide the wheel 16 a loading through the belt 22 that the user may use to train his/her hands by turning the cranks 39*e*.

When a user turns the cranks 39*e* in a forward direction, i.e., clockwise, as shown in FIG. 2, to turn the main axle 31 in the forward direction, it turns the driving wheel 32 in the forward direction through the forward one-way clutch 33, and then the driving wheel 32 drives the wheel 16 rotating in the forward direction through the belt 32*c*. The damping device 20 provides the wheel 16 a loading through the belt 22. In this condition, the transmission gear 34 is turned in a backward direction by the turning gear 37, but the rotation of the transmission gear 34 will not interfere with the rotation of the driving wheel 32 because of the backward one-way clutch 35.

The exercise bike 100 of the present invention provides user the first exercise module 30 for training their hand. It provides user a comfortable posture to operate the first exercise module 30, and the damping device 20 works no matter which direction user turns the main axle 31 in.

Figure 8:
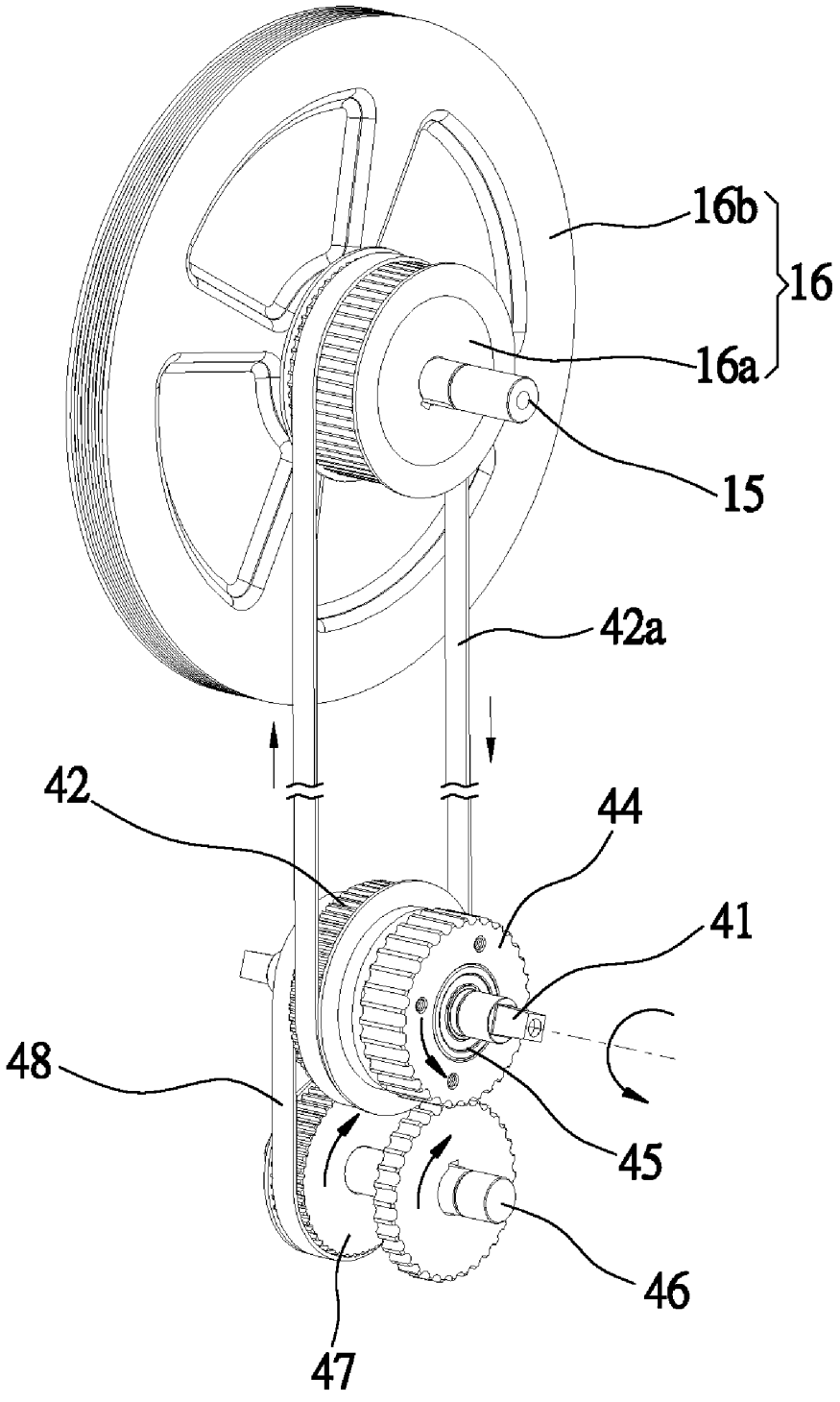
FIG. 8 is a sketch diagram of the switching wheel of the relationship of the bike and the first exercise module.

The second exercise module 40 is designed for training feet. The second exercise module 40 is mounted on the second case 18 distal to the axle 15. As shown in FIG. 4 and FIG. 8, the second exercise module 40 includes a main axle 41, a driving wheel 42, a forward one-way clutch 43, a transmission gear 44, a backward one-way clutch 45, a positioning axle 46, a turning gear 47, a belt 48, and two operation sets 49.

Basically, the second exercise module 40 is the same as the first exercise module 30. The corresponding elements of the main axle 41, the driving wheel 42, the forward one-way clutch 43, the transmission gear 44, the backward one-way clutch 45, the positioning axle 46, the turning gear 47, and the belt 48 of the second exercise module 40 are the main axle 31, the driving wheel 32, the forward one-way clutch 33, the transmission gear 34, the backward one-way clutch 35, the positioning axle 36, the turning gear 37, and the belt 38 of the first exercise module 30. They have the same structures and functions, so we do not describe the details of the second exercise module 40 here.

Each of the operation sets 49 of the second exercise module 40 has a crank 49*a* and a pedal 49*b*. The crank 49*a* has an end connected to the main axle 41 and the pedal 49*b* is pivoted on a distal end of the crank 49*a*. The driving wheel 42 is connected to the outer wheel 16*a* of the wheel 16 through a belt 42*a* that the main axle 41 drives the transmission gear 44 rotating in the backward direction through the forward one-way clutch 45 when a user steps on the pedals 49*b* and turns them in the backward direction, and then the transmission gear 44 drives the driving wheel 42 rotating in the forward direction to drive the wheel 16 rotating in the forward direction through the belt 42*a*. The damping device 20 provides a loading to train user's feet. On the contrary, the wheel 16 is rotated in the forward direction through the belt 42*a* also when the user steps on the pedals 49*b* and turns them in the forward direction to train his/her feet.

The first exercise module 30 and the second exercise module 40 of the present invention provide the one-way clutches 33, 35, 43, 45 to transmit power in opposite directions that the motions of one exercise modules will not be transmitted to the other module. In other words, the main axle of one exercise module will keep still when the other exercise module is operated. User may independently operate the first exercise module 30 and the second exercise module 40 without interference. That is, user may operate the exercise bike 100 of the present invention to train his/her hand or feet individually.

The description above is a few preferred embodiments of the present invention and the equivalence of the present invention is still in the scope of claim construction of the present invention.

What is claimed is:

1. An exercise bike, comprising:

a frame;

a first exercise module, which is connected to the frame, including a main axle, a driving wheel mounted on the main wheel, and a forward one-way clutch between the main axle and the driving wheel, wherein the main axle is driven to rotate in a forward direction and a backward direction that the driving wheel is driven to rotate in the forward direction through the forward one-way clutch when the main axle rotates in the forward direction;

a second exercise module, which is connected to the frame, including a main axle, a driving wheel mounted on the main wheel, and a forward one-way clutch between the main axle and the driving wheel, wherein the main axle is driven to rotate in a forward direction and a backward direction that the driving wheel is driven to rotate in the forward direction through the forward one-way clutch when the main axle rotates in the forward direction; and a damping device having a driven wheel connected to the frame, wherein the driving wheel of the first exercise module and the driving wheel of the second exercise module are connected to the driven wheel respectively for driving the driven wheel to rotate;

wherein the first exercise module further includes a transmission gear mounted on the main axle, a backward one-way clutch between the main axle and the transmission gear that the transmission gear is driven to rotate in the backward direction through the backward one-way clutch when the main axle rotates in the backward direction, and a turning gear meshed with the transmission gear to rotate the driving wheel; and wherein the second exercise module further includes a transmission gear mounted on the main axle, a backward one-way clutch between the main axle and the transmission gear that the transmission gear is driven to rotate in the backward direction through the backward one-way clutch when the main axle rotates in the backward direction, and a turning gear meshed with the transmission to rotate the driving wheel.

2. The exercise bike as defined in claim 1, further comprising a wheel, which is pivoted on the frame by an axle, having an outer wheel and an inner wheel, wherein the driving wheel of the first exercise module is connected to the outer wheel through a belt, the driving wheel of the second exercise module is connected to the outer wheel through a belt, and the driven wheel of the damping device is connected to the inner wheel through a belt.

3. The exercise bike as defined in claim 2, wherein the frame includes a first case, in which the first exercise module is provided, a second case, in which the second exercise module is provided, and an orienting device, and further wherein the first case and the second case have portions overlapped for the axle of the wheel to pass through, and the orienting device connects the first case and the second case to adjust an angle between the first case and the second case.

4. The exercise bike as defined in claim 3, wherein the orienting device includes a cylinder with a cylinder member pivoted on the second case and a shaft extending out of the cylinder member to be pivoted on the first case.

5. The exercise bike as defined in claim 3, wherein the first exercise module further includes at least an operation set having a linkage with an end connected to the main axle, a connector pivoted on an opposite end of the linkage, and a crank pivoted on the connector.

6. The exercise bike as defined in claim 5, wherein the operation set further includes a sheath fitted to the main axle, and the main axle has a threaded hole, the linkage has a slot, and a fastener passing through the slot of the linkage and screwed into the threaded hole of the main axle to secure the linkage to the main axle.

7. The exercise bike as defined in claim 1, wherein the first exercise module further includes a positioning axle, on which the turning gear is mounted, and a belt, and further wherein the driving wheel includes a first gear and a second gear, and the turning gear includes a first gear meshed with the first gear of the driving wheel and a second gear connected to the second gear of the driving wheel through the belt.

8. The exercise bike as defined in claim 1, wherein the second exercise module further includes a positioning axle, on which the turning gear is mounted, and a belt, and further wherein the driving wheel includes a first gear and a second gear, and the turning gear includes a first gear meshed with the first gear of the driving wheel and a second gear connected to the second gear of the driving wheel through the belt.

9. An exercise bike, comprising:

a frame;

a first exercise module, which is connected to the frame, including a main axle, a driving wheel mounted on the main wheel, and a forward one-way clutch between the main axle and the driving wheel, wherein the main axle is driven to rotate in a forward direction and a backward direction that the driving wheel is driven to rotate in the forward direction through the forward one-way clutch when the main axle rotates in the forward direction;

a second exercise module, which is connected to the frame, including a main axle, a driving wheel mounted on the main wheel, and a forward one-way clutch between the main axle and the driving wheel, wherein the main axle is driven to rotate in a forward direction and a backward direction that the driving wheel is driven to rotate in the forward direction through the forward one-way clutch when the main axle rotates in the forward direction; and a damping device having a driven wheel connected to the frame, wherein the driving wheel of the first exercise module and the driving wheel of the second exercise module are connected to the driven wheel respectively for driving the driven wheel to rotate;

further comprising a wheel, which is pivoted on the frame by an axle, having an outer wheel and an inner wheel, wherein the driving wheel of the first exercise module is connected to the outer wheel through a belt, the driving wheel of the second exercise module is connected to the outer wheel through a belt, and the driven wheel of the damping device is connected to the inner wheel through a belt;

wherein the frame includes a first case, in which the first exercise module is provided, a second case, in which the second exercise module is provided, and an orienting device, and further wherein the first case and the second case have portions overlapped for the axle of the wheel to pass through, and the orienting device connects the first case and the second case to adjust an angle between the first case and the second case;

wherein the first exercise module further includes at least an operation set having a linkage with an end connected to the main axle, a connector pivoted on an opposite end of the linkage, and a crank pivoted on the connector; and wherein the operation set further includes a sheath fitted to the main axle, and the main axle has a threaded hole, the linkage has a slot, and a fastener passing through the slot of the linkage and screwed into the threaded hole of the main axle to secure the linkage to the main axle.

10. An exercise bike, comprising:

a frame;

a first exercise module, which is connected to the frame, including a main axle, a driving wheel mounted on the main wheel, and a forward one-way clutch between the main axle and the driving wheel, wherein the main axle is driven to rotate in a forward direction and a backward direction that the driving wheel is driven to rotate in the forward direction through the forward one-way clutch when the main axle rotates in the forward direction;

a second exercise module, which is connected to the frame, including a main axle, a driving wheel mounted on the main wheel, and a forward one-way clutch between the main axle and the driving wheel, wherein the main axle is driven to rotate in a forward direction and a backward direction that the driving wheel is driven to rotate in the forward direction through the forward one-way clutch when the main axle rotates in the forward direction; and a damping device having a driven wheel connected to the frame, wherein the driving wheel of the first exercise module and the driving wheel of the second exercise module are connected to the driven wheel respectively for driving the driven wheel to rotate;

wherein the second exercise module further includes a transmission gear mounted on the main axle, a backward one-way clutch between the main axle and the transmission gear that the transmission gear is driven to rotate in the backward direction through the backward one-way clutch when the main axle rotates in the backward direction, and a turning gear meshed with the transmission to rotate the driving wheel; and wherein the second exercise module further includes a positioning axle, on which the turning gear is mounted, and a belt, and further wherein the driving wheel includes a first gear and a second gear, and the turning gear includes a first gear meshed with the first gear of the driving wheel and a second gear connected to the second gear of the driving wheel through the belt.

* * * * *